US005472170A

United States Patent [19]

Anasson

[11] Patent Number: 5,472,170

[45] Date of Patent: Dec. 5, 1995

[54] STRETCHING METHOD AND APPARATUS

[75] Inventor: Nicholas Anasson, Holt, Australia

[73] Assignee: Caresse Donealia Anasson, Holt, Australia

[21] Appl. No.: 64,127

[22] PCT Filed: Nov. 21, 1991

[86] PCT No.: PCT/AU91/00543

§ 371 Date: May 21, 1993

§ 102(e) Date: May 21, 1993

[87] PCT Pub. No.: WO92/09226

PCT Pub. Date: Jun. 11, 1992

[30] Foreign Application Priority Data

Nov. 21, 1990 [AU] Australia ..... PK3457

[51] Int. Cl.[6] ..... B65H 77/00

[52] U.S. Cl. ..... 254/212; 254/201; 254/207

[58] Field of Search ..... 254/200–212

[56] References Cited

U.S. PATENT DOCUMENTS

| | | | |
|---|---|---|---|
| 326,063 | 9/1885 | Sprague | 254/209 |
| 388,864 | 9/1888 | Hall | 254/212 |
| 468,333 | 2/1892 | Egler | 254/211 X |
| 611,344 | 9/1898 | Wagner | 254/206 |
| 1,006,409 | 10/1911 | Rowe | 254/211 |
| 1,766,423 | 6/1930 | Bartlow | 254/212 |
| 2,108,506 | 2/1938 | Owens . | |
| 2,606,743 | 8/1952 | Owens | 254/212 |
| 3,300,182 | 1/1967 | Bussard | 254/212 |
| 3,311,347 | 3/1967 | Thompson | 254/204 |
| 3,441,252 | 4/1969 | Koppelmans . | |
| 3,693,936 | 9/1972 | Payson . | |
| 4,008,879 | 2/1977 | Youngman | 254/201 |
| 4,042,211 | 8/1977 | Hammond et al. . | |
| 4,084,787 | 4/1978 | Kowalczyk . | |
| 4,934,658 | 6/1990 | Berg et al. . | |
| 5,228,660 | 7/1993 | Massicotte | 254/201 |

FOREIGN PATENT DOCUMENTS

| | | |
|---|---|---|
| 3984789 | 2/1990 | Australia . |
| 5493490 | 2/1991 | Australia . |
| 1291478 | 3/1969 | Germany . |
| 2007000 | 2/1971 | Germany . |

*Primary Examiner*—Daniel P. Stodola
*Assistant Examiner*—Michael R. Mansen
*Attorney, Agent, or Firm*—Dvorak and Traub

[57] ABSTRACT

A carpet stretching assembly is disclosed which includes a ladder-type mounting structure engaged by releasable stretching member. The stretching member are actuated by a hydraulic ram or ratchet jack to engage the mounting structure and thereby apply force to stretch a carpet via a gripping head assembly which engages the carpet. The stretched carpet is held in its stretched condition by positioning carpet holding member to engage the mounting structure and grip the carpet by a gripping head assembly.

12 Claims, 7 Drawing Sheets

STRETCHING METHOD AND APPARATUS

BACKGROUND OF THE INVENTION

This invention relates to apparatus for stretching or tensioning sheet-like material such as carpet and to methods of stretching or tensioning such material.

This invention has particular but not exclusive use to the stretching of carpets, and for illustrative purposes reference will be made to such application. However it will be understood that this invention could be used in other applications where the stretching or tensioning of sheet-like material is required and references herein to "carpet" are to be construed as including reference to other sheet-like material.

DESCRIPTION OF THE PRIOR ART

Known carpet stretching equipment includes an extendable pole or support rod to which is attached a carpet gripping head or stopper. One end of the support rod is positioned against a wall of the area to be carpeted with the other remote end carrying the gripping head or stopper which grips the carpet with a large number of downwardly projecting spikes. The carpet is stretched by the application of force or pressure to the gripping head so as to cause the gripping head to move relative to the supporting pole. This arrangement is used for domestic installations as well as for large scale commercial installations. In practice the length of carpet runs which may be efficiently stretched by this method is limited to lengths of about twenty meters. Thus, where an extended length of carpet such as sixty or eighty meters is to be laid in commercial or industrial applications, the carpet must be stretched to this shorter distance and then tacked down or stay-nailed intermediate its length. The stretching equipment is then repositioned or extended and the stretching operation recommenced.

It is also necessary with existing arrangements for the stretching operation to be carried out repeatedly across the width of a carpet. This adds considerably to the time and effort required to lay the carpet.

Another disadvantage associated with the existing stretchers occurs when separate lengths of carpets are joined by applying a heat activated thermoplastic adhesive tape to adjoining seams o the carpet. Because the adhesive tape is not meant to be stretched, it is important that the lengths of carpet to be joined are equally stretched before application of the tape. As the requisite equal stretching is very difficult to achieve, joints often fail by cupping and breaking of the adhesive bond.

The current methods are time consuming and do not enable carpet to be stretched uniformly across its length and width. Consequently it is difficult with existing equipment to meet required standards when laying carpet, although experienced and skillful layers are able to approximate the standards required. Nevertheless it is not uncommon for bubbling and premature wearing to occur.

This invention aims to alleviate at least one of the above mentioned disadvantages and to provide stretching apparatus which will be reliable and efficient in use. Other objects and advantages of this invention will hereinafter become apparent.

DESCRIPTION OF THE PRESENT INVENTION

With the foregoing and other objects in view, this invention in one aspect resides broadly in a carpet stretching assembly including;

an elongate mounting structure having a ladder type frame adapted to rest stably upon a carpeted surface;

anchoring means associated with said mounting structure;

releasable stretching means engageable with said mounting structure and operable to stretch carpet from a selected portion thereof in the longitudinal direction of said mounting structure, and carpet holding means engageable with said mounting structure intermediate said stretching means and said anchoring means.

Preferably the mounting structure includes a plurality of scaffold frames adapted for assembly in end to end relationship. It is preferred that the mounting structure is constructed from aluminium or other light weight material having the required strength characteristics. It is also preferred that the width of each module of the mounting structure and the length thereof be such as will facilitate ready access by stairs, lifts, doors etc to areas where carpet is being laid.

The releasable stretching means and/or the carpet holding means may include any suitable arrangement whereby a carpet or the like may be gripped or otherwise firmly held with the grip not being broken by the application of pressure thereto. They could for example include an edge gripping device with a frictional gripping action. However it is preferred that the releasable stretching means and/or said carpet holding means includes a gripping head assembly adapted to releasably grip the carpet. Suitably the gripping head assembly includes at least one gripping head having an array of inclined spikes projecting downwardly therefrom. It is preferred that the gripping head assembly includes at least three said gripping heads arranged such that one said gripping head is positioned centrally of said mounting structure and the other said gripping heads are respectively positioned transversely on either side thereof.

The releasable stretching means and/or said carpet holding means may include actuating means adapted to move said gripping head assembly relative to said mounting structure. The actuating means could for example be remote controlled and servo driven or could be manually operable. Suitably the actuating means includes a ratchet mechanism or a hydraulic jacking mechanism.

The releasable stretching means may be fixedly mounted to the mounting structure by separately attaching a portion of the stretching means to the frame so as to permit the member carrying the gripping heads to be moveable relative to the fixedly attached portion. Alternatively the releasable stretching means may be movably mounted on the mounting structure by means of wheels or runners adapted to enable the stretching means to move along the mounting structure.

In a preferred embodiment the releasable stretching means and/or said carpet holding means includes:

a frame supporting said gripping head assembly, conveying means on said frame whereby said releasable stretching means and/or said carpet holding means is moveable relative to said mounting structure, and abutment means engageable with corresponding abutment means on said mounting structure whereby said releasable stretching means and/or said carpet holding means is engageable with said mounting structure.

Suitably the conveying means includes a plurality of wheels mounted on said frame and adapted to transport said releasable stretching means and/or said carpet holding means across the carpet and above and along said mounting structure, and said abutment means includes at least one transversely extending face adapted to engage a transversely extending member on said mounting structure.

The stretching assembly may include calibration means whereby the degree of stretch may be determined and monitored. The calibration means may be connected to a print-out device to provide a printed record.

The anchoring means may be a gripping head assembly adapted to releasably grip the carpet or it may be an abutment adapted to abut a wall or the like at which the carpet is secured. Preferably the abutment means is an end of said mounting structure.

In a further aspect this invention resides broadly in a method of stretching laid carpet, said method including:

arranging an elongate mounting structure on the laid carpet;

anchoring said mounting structure relative to the laid carpet;

releasably connecting stretching means to said mounting structure whereby carpet may be stretched away from said anchoring;

actuating said stretching means to stretch a first portion of the carpet in the longitudinal direction of said mounting structure;

connecting holding means to said mounting structure at a first holding position intermediate said stretching means and said anchoring whereby the stretched first portion of carpet is maintained in a stretched state;

releasably re-connecting said stretching means to said mounting means beyond said holding means whereby carpet may be stretched away from said holding means;

actuating said stretching means to stretch a further portion of the carpet in the longitudinal direction of said mounting structure, and re-connecting said holding means to said mounting structure at a second holding position intermediate said stretching means and said first holding position whereby the stretched further portion of carpet is maintained in a stretched state.

DETAILED DESCRIPTION OF THE INVENTION

Figure 1:
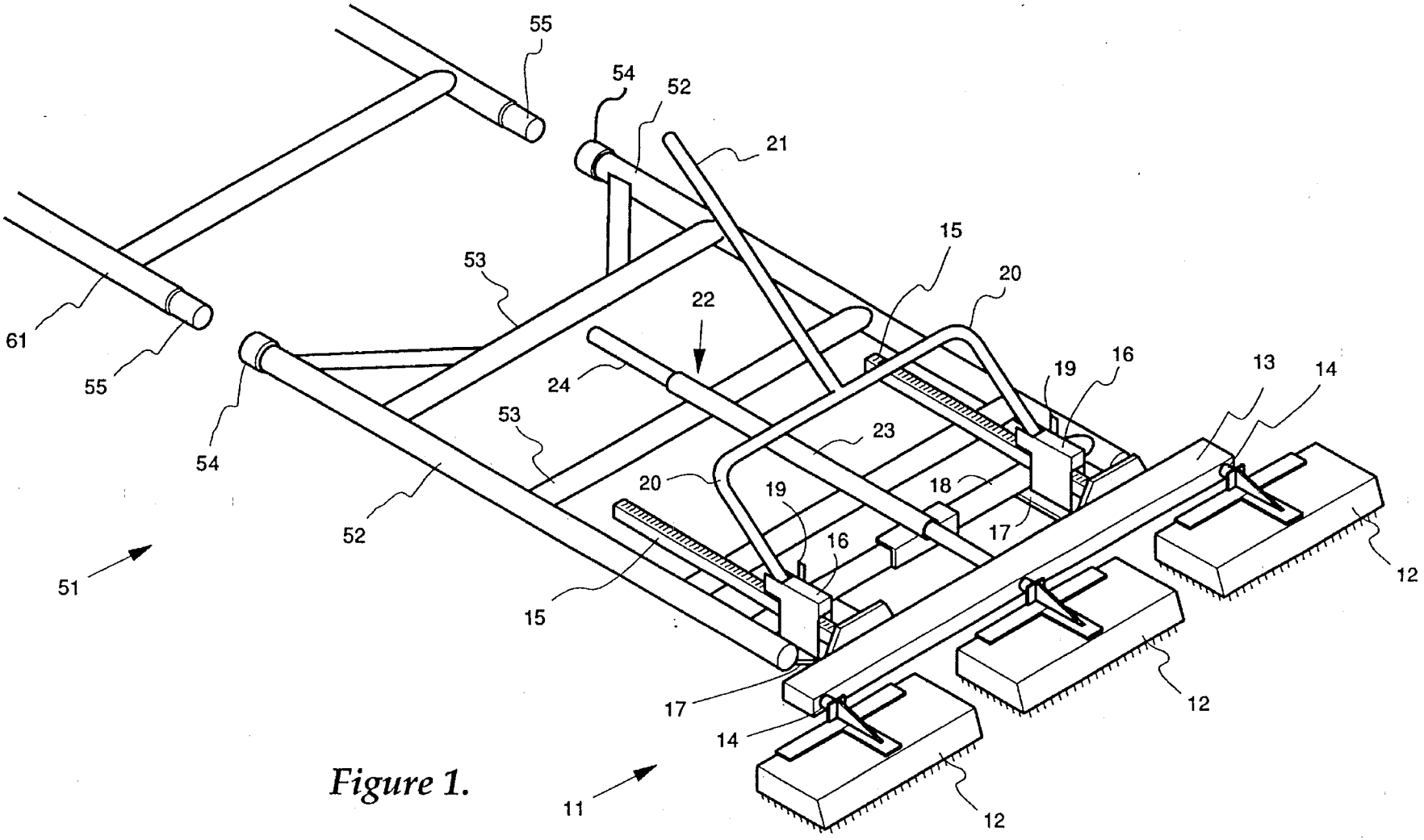
FIG. 1 illustrates a stretching assembly with one form of releasable stretching means attached to a mounting structure.

As can be seen in FIG. 1, the stretching assembly includes releasable stretching means 11 fixedly attached to the module 51 of a mounting structure. The releasable stretching means has three gripping heads 12 attached to a crossbar 13 by means of spigot mounts 14. The spigot mounts 14 are retained in the crossbar 13 by latches (not shown). The crossbar 13 may be selectively urged away from the mounting frame module 51 by ratchet jacking mechanisms 15, 16 fixed to the leading crossbar 18 of the mounting frame 51 with the ratchet housings 16 welded or otherwise affixed to gusset plates 17 welded to the crossbar 18. An additional central slide mounting 22 is provided by an elongate rod 24 attached to the crossbar 13 being slidably received in a cylindrical housing 23 affixed to a transverse rung 53 and the leading crossbar 18 of the module 51. The slide mounting 22 assists in maintaining structural integrity between the mounting frame module 51 and the crossbar 13. The jacking mechanisms 15, 16 are operated by a common actuating lever 21 connected to the jacking mechanisms by yoke 20 whereby each end of the crossbar 13 is simultaneously advanced. Release means 19 are provided to release the jacking mechanisms so that the gripping heads may be disengaged from the carpet.

The mounting frame module 51 has sockets 54 at one end of the side rails 52 for receiving the other male ends 55 of the side rails of a conventional aluminium scaffold frame 61 whereby the effective length of the mounting frame may be increased step wise by selectively adding further scaffold frames 61 in end to end relationship to the mounting frame. In this manner readily available scaffold frames 61 may be obtained to increase the effective length of the mounting frame to any desired length. The male ends 55 are a relatively loose fit whereby the mounting frame may be pivoted upwardly with respect to the connected scaffold frames 61 to enable the gripping heads to be raised for release from the carpet.

Figure 2:
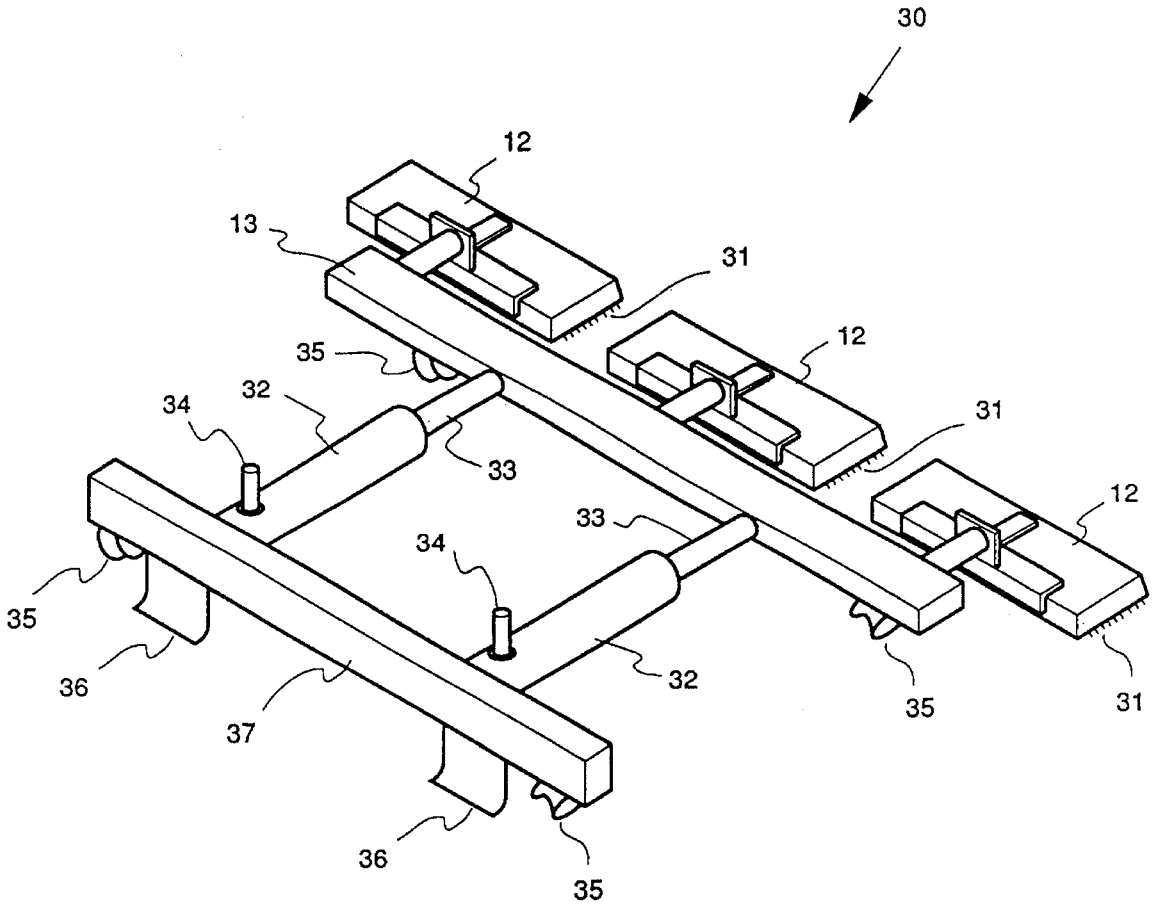
FIGS. 2–4 illustrate alternative forms of a releasable stretching means in accordance with the invention.

As can be seen in FIG. 2, the releasable stretching means 30 includes a pair of hydraulic rams 32 arranged to advance the gripping heads 12. The hydraulic rams have pistons 33 fixedly attached to the leading cross-bar member 13 with the cylinders 32 being affixed to a second and trailing cross-bar member 37. The hydraulic rams 32 include actuating or pumping levers 3A adapted to incrementally advance the pistons 33 by repeated operation thereof.

Each of the cross-bar members 37 and 13 have a pair of concave wheels 35 mounted thereon to be complementarily engageable with and able to run along the parallel side members 52 of the mounting frame. The wheels 35 are mounted at a slight angle to the vertical such that the stretching means is able to freely track along the side members 52.

As can be seen in FIG. 2, the gripping heads 12 have an array of forwardly inclined depending spines 31 for engaging and gripping the carpet in a conventional manner.

The stretching means 30 illustrated in FIG. 2 thus comprises a trolley-like assembly adapted to move freely along an extended mounting frame. The cross-bar member 37 carries a pair of pawls 36 hingedly connected thereto whereby they may pivot rearwardly to enable the stretching means 30 to pass across the transverse rungs 53 of the mounting frame and to rest in front of the rung to form an abutment against which the stretching means abut when the hydraulic rams 32 are actuated.

Figure 3:
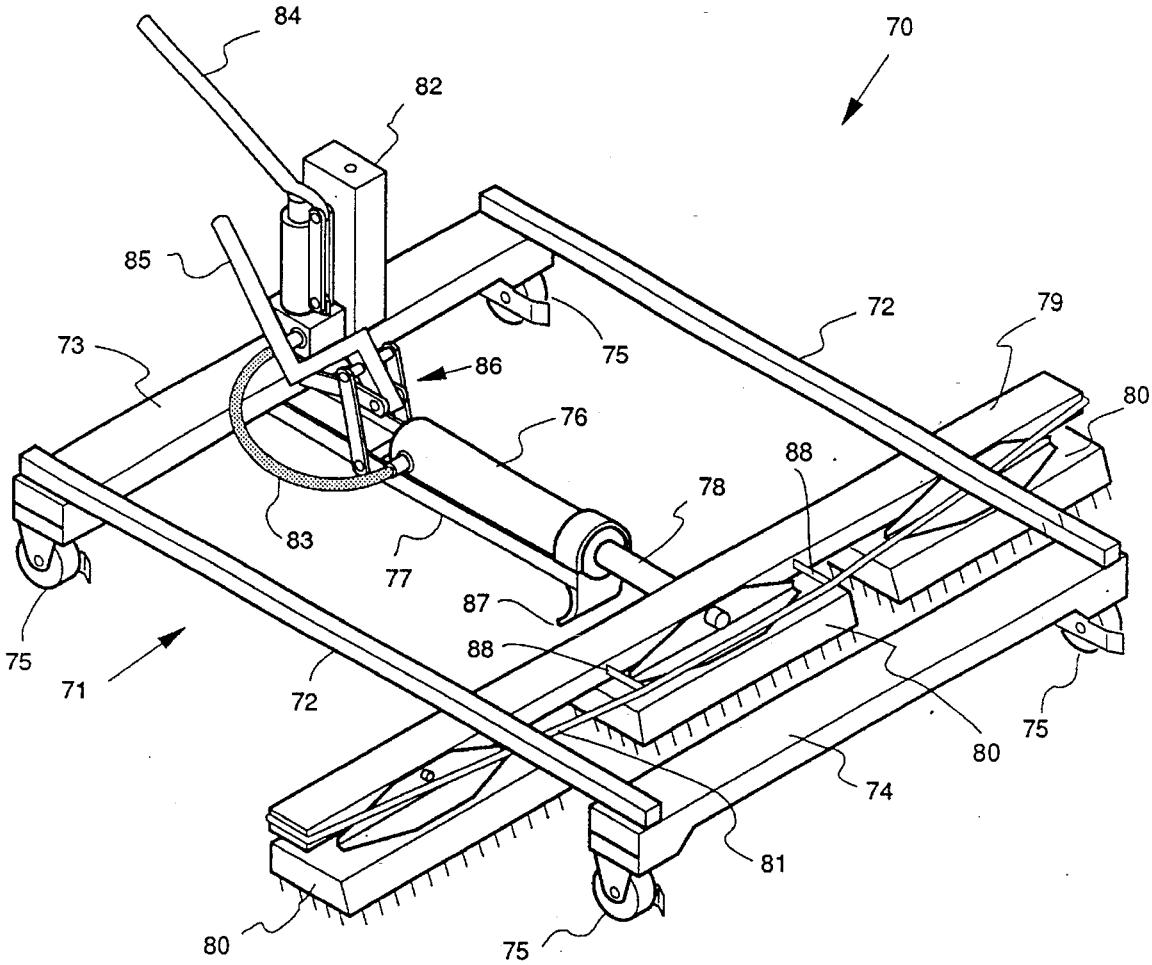

The releasable stretching means 70 illustrated in FIG. 3 has a supporting frame 71 mounted on wheels 75 such that the stretching means 70 is able to travel along the laid carpet over the mounting frame 61 as the wheels 75 track along the carpet outside the side rails 52 of the mounting frame 61. The supporting frame 71 has a pair of side members 72 supporting a leading cross member 74 and a trailing cross member 73. The wheels 75 are pivotally mounted at respective ends of the cross members 73 and 74. The trailing crossmember 73 supports a hydraulic fluid reservoir 82 from which hydraulic fluid is pumped to a hydraulic jack 76 via suitable hosing 83 by the action of pump handle 84. The hydraulic jack 76 is cradled in a supporting arm 77 pivotally mounted on the trailing cross member 73 to rotate about a transverse axis. A mounting structure engagement bracket 87 depends from the supporting arm 77 so as to be engageable with a transverse rung 53 of the mounting structure 61 in a lowered position of the supporting arm 77. The hydraulic actuated piston 78 is attached to a cross bar 79 which carries three conventional gripping heads 80. Bowing of the cross bar 79 is prevented by a tensioning brace 81 welded to the ends thereof and separated therefrom in the central region by struts 88. The gripping head assembly can be raised to an elevated position at which the gripping heads 80 clear the carpet, or can be lowered to a carpet engaging position by the action of a lifting handle 85. The lifting handle 85 is operable through a series of linkages 86 to retain the elevated head assembly in stable equilibrium in an over-centre position.

In use the releasable stretching means 70 is rolled along the carpet over the mounting structure and when positioned at an appropriate location to commence stretching the carpet, the cross member 79 and associated gripping heads 80 is lowered to engage the carpet by lowering the lifting mechanism 85. When pressure is applied by pump handle 84 to move the stretching means, the engagement of the gripping heads 80 with the carpet causes the stretching assembly 70 to roll backwards on wheels 75 until the mounting structure engagement bracket 87 bears on and is restrained by a transverse rung 53 on the mounting structure 61. Further actuation of the pump handle 84 causes the carpet to be stretched.

Figure 4:
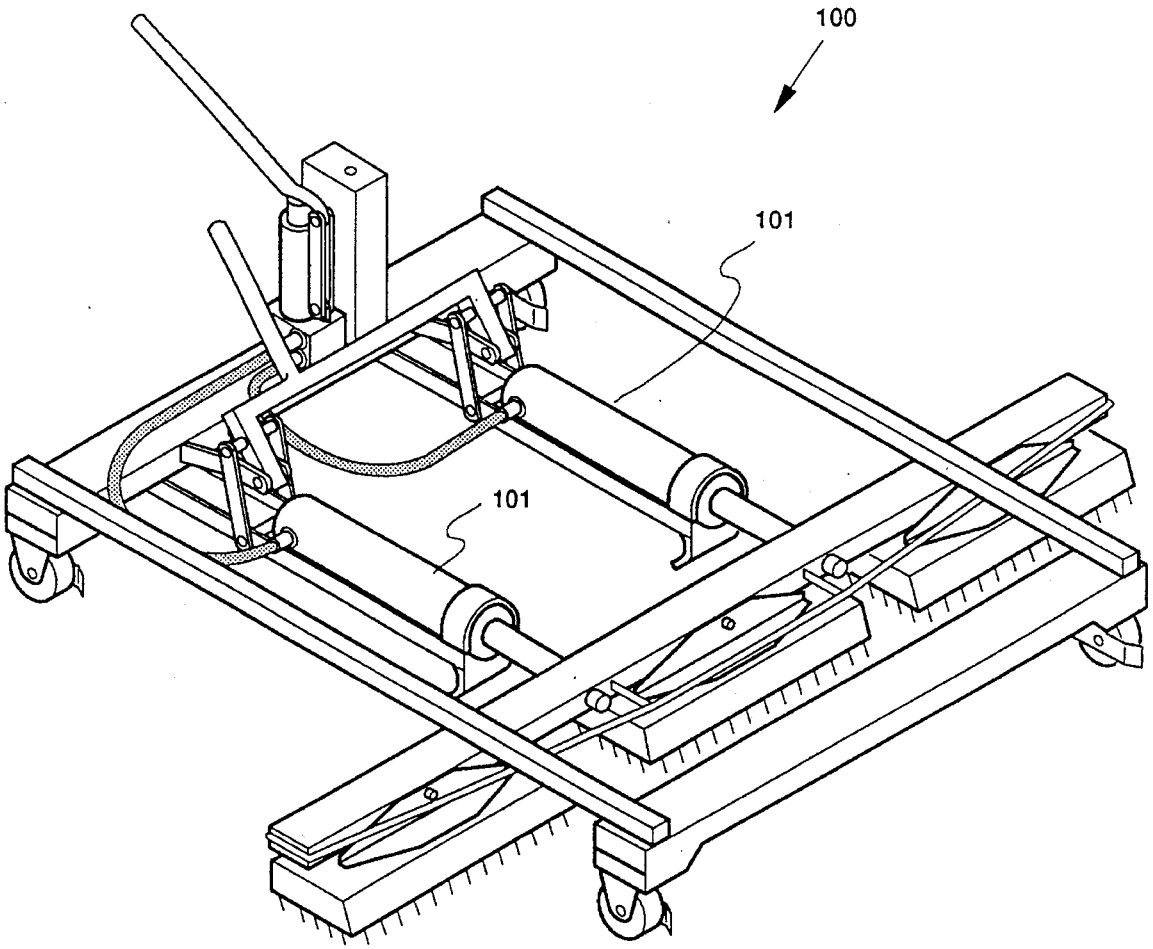

The releasable stretching means 100 as seen in FIG. 4 is substantially similar to that illustrated in FIG. 3 except that a pair of transversely spaced hydraulic jacks 101 are provided instead of a central jack.

It will of course be obvious that the various stretching means illustrated in FIGS. 1 to 4 are completely interchangeable in as much as the hydraulic embodiments illustrated in FIGS. 2 to 4 could include the arrangement of permanent affixing of one portion of the stretching means to the mounting frame, whilst the ratchet mechanism illustrated in FIG. 1 could also be mounted on wheels to provide a trolley-like stretching means.

In an alternative embodiment (not illustrated) the arrangement shown in FIGS. 3 and 4 is varied so that the gripping head assembly is positioned ahead of the leading edge of the wheeled support frame thereby enabling the gripping head to abut a wall or skirting board against which the carpet is to be fixed.

Figure 5:
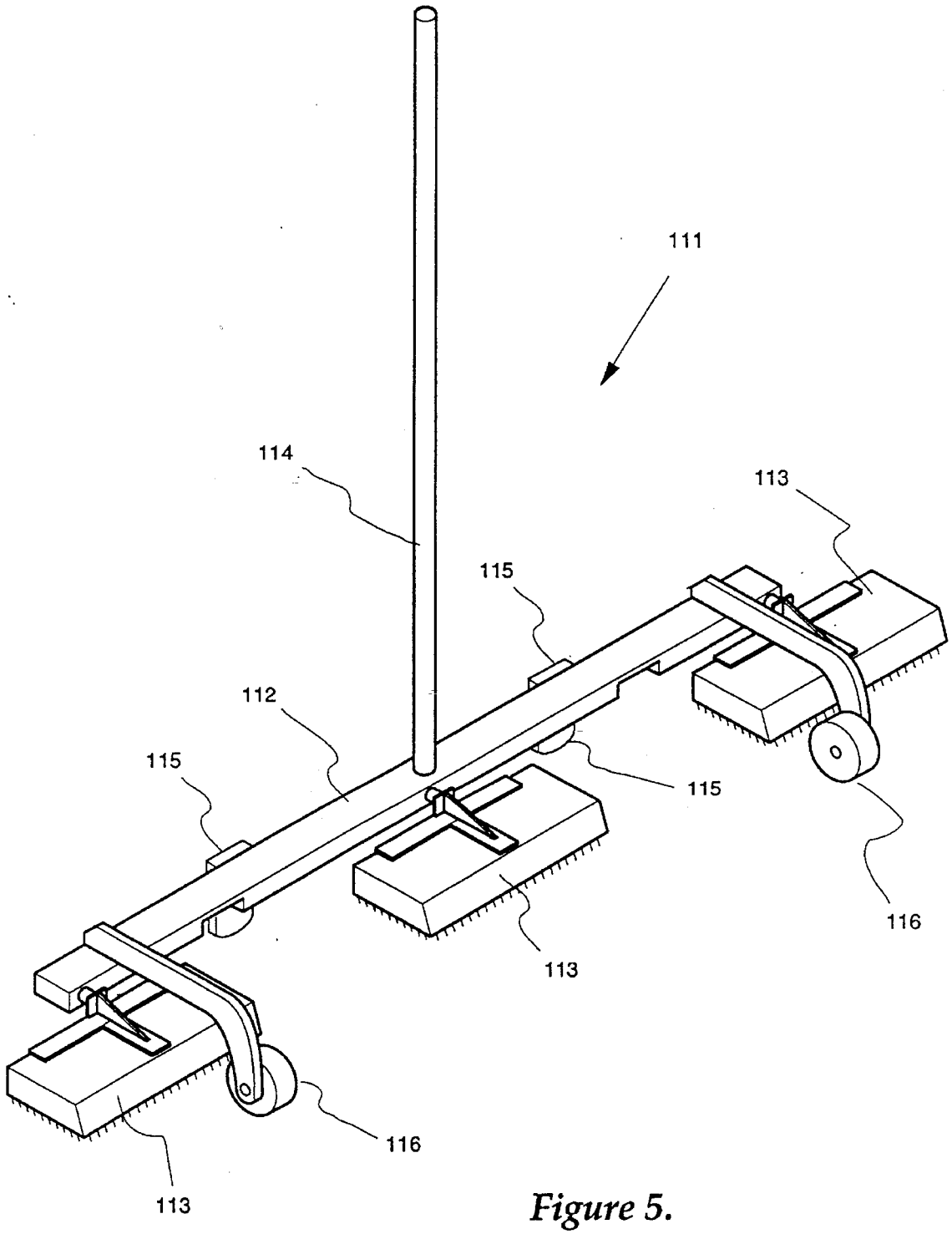
FIG. 5 illustrates one form of a carpet holding means.

FIG. 5 illustrates a carpet holding means 111 by means of which carpet stretched by the releasable stretching means is maintained in its stretched condition. A cross bar 112 supports three gripping heads 113 in transverse spaced relation similar to the gripping head assembly of the releasable stretching means. A pair of transversely spaced abutment faces 115 depend from the crossbar 112 and are spaced to abut a transverse rung 53 of the scaffold frame 61. The cross bar 112 also supports a pair of wheels 116 and an upwardly extending handle 114.

In use, the carpet holding means 111 is positioned behind a releasable stretching means such that the abutment faces 115 abut a transverse rung 53 of the scaffold frame 61. When the releasable stretching means is released, the stretched carpet is maintained in its stretched condition by the gripping action on the carpet of the holding means 111. When the releasable stretching means is re-positioned and the carpet restretched to its new position, the carpet holding means 113 can be disengaged from the carpet at its first position by pivoting the handle 114 forward so that the holding means 111 pivots on the wheels 116 thereby raising the gripping heads 113 and disengaging them from the carpet. The carpet holding means thus clears the mounting structure and is then rolled along the carpet over the mounting structure to its new holding position adjacent the re-positioned stretching means.

Figure 6:
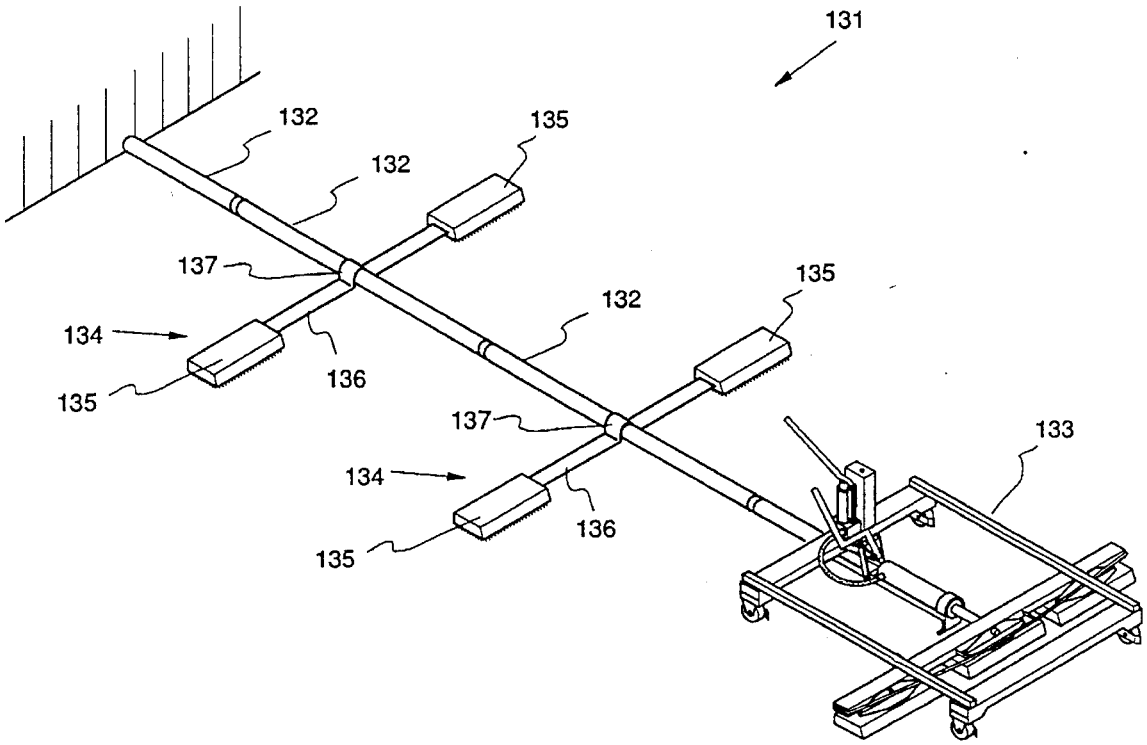
FIG. 6 illustrates a pole-like mounting structure with stabilising means, and FIGS. 7(*a*) to 7(*e*) illustrates the stages in using the carpet stretching assembly in accordance with the invention.
Figure 7A:
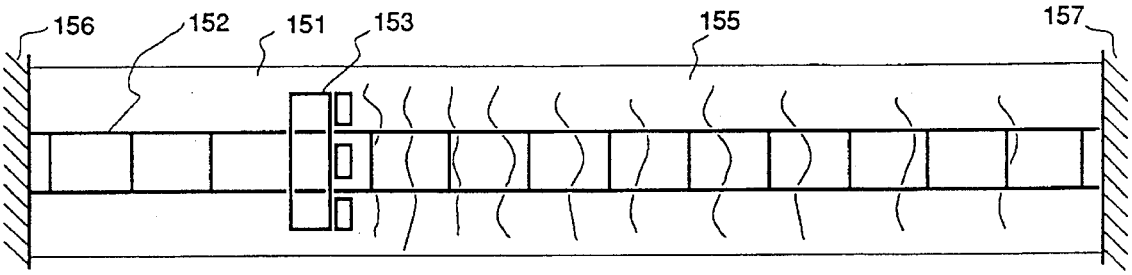
Figure 7B:
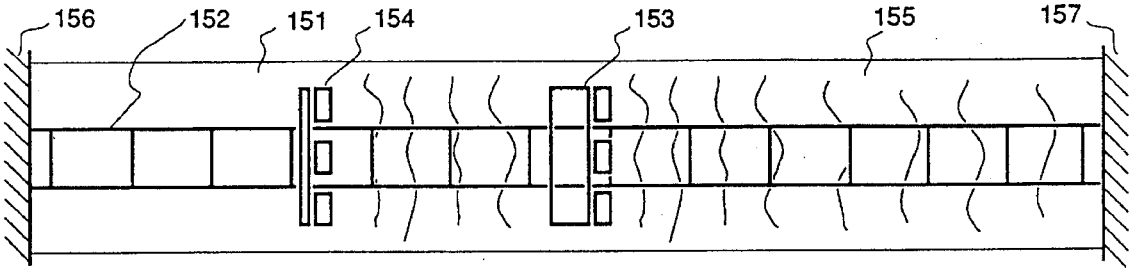
Figure 7C:
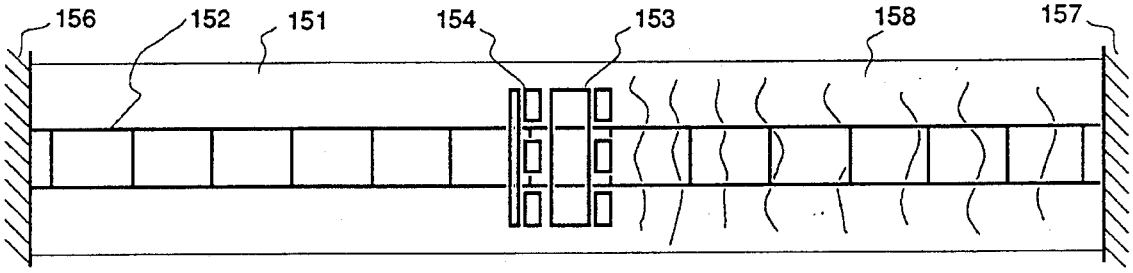
Figure 7D:
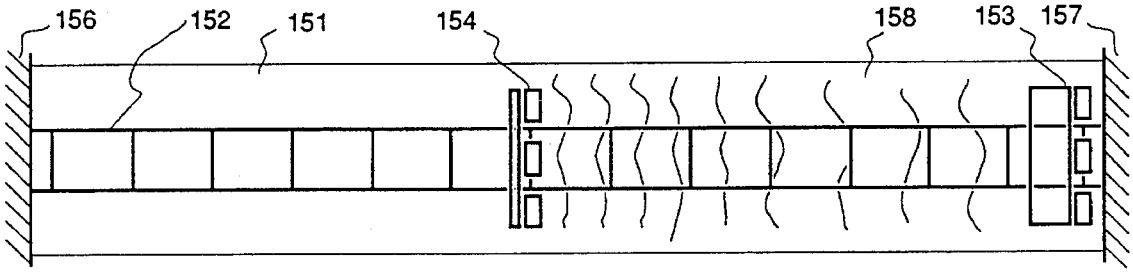
Figure 7E:
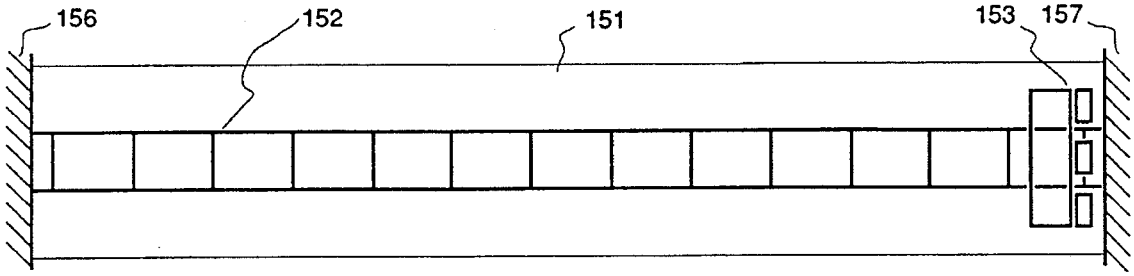

As seen in FIG. 6, the mounting structure may include a number of elongated rods 132 adapted to interlock to form an extendable pole-like assembly 131 adapted to carry a releasable stretching means 133 along its length. In order that pressure applied to the column via the stretching means 133 does not cause buckling and bowing, a number of carpet engaging stablising means 134 are positioned along the length of the mounting structure. Each stablising means 134 includes a pair of transversally spaced gripping heads 135 joined by a bridging element 136 having a central collar or yoke 137 which sits over the elongated rods to prevent lateral movement thereof. The collars 137 abut retention means (not shown) on the mounting structure whereby the bridging element 136 constitutes a transverse rung against which both the stretching means 133 and a carpet holding means can bear during stretching operations.

FIGS. 7(*a*) to 7(*e*) illustrate the stages followed in the stretching operation. A length of carpet 151 is laid out along the area to be carpeted between walls or skirting boards 156 and 157. A mounting structure 152 is assembled and laid on the carpet along its full length. Stretching means 153 is then positioned as seen in FIG. 7(*a*) and the carpet stretched between the wall and the stretching means. As seen in FIG. 7(*b*) a carpet holding means 154 is then positioned adjacent the stretching means 153 which are then re-positioned further along the mounting structure.

The carpet is then again stretched and the holding means repositioned as shown in FIG. 7(*c*). As seen in FIG. 7(*d*) the stretching means 153 is repositioned at the end of the carpet run and after further stretching the holding means 154 can be removed as seen in FIG. 7(*e*). The unstretched portion of carpet, 155 in FIGS. 7(*a*) and 7(*b*) and 158 in FIGS. 7(*c*) and 7(*d*), decreases as the process continues.

The stretching apparatus in accordance with this invention may be used in numerous ways to stretch carpet in accordance with desirable practices and with the required specifications. Preferably the stretching sub-frames or scaffold frames or modules are laid out and connected to provide a mounting structure which extends across the entire length of the carpet being laid, even if such length is in excess of 50 meters.

For example if a pair of stretching means are utilised the carpet can be first stretched across its entire length or across a substantial component of the total length, and then further stretched by utilising a second intermediate stretching means.

However it is preferred that a stretching means is used in association with holding means so that the carpet is uniformly and progressively stretched by sequentially applying the stretching means, holding the stretched carpet in place with the holding means and then repeating the steps with the stretching means advanced along the mounting structure. Furthermore, because of the degree of control provided by the present invention and the considerably broader head which may be used effectively with the present invention, the number of passes required to stretch a given width of carpet can be significantly reduced.

Equally it is possible in accordance with the present invention to utilise a fixed stretching means at the end of the carpet and to operate with a pair of travelling stretching means, or with stretching means combined with holding means in the intermediate portions.

It will of course be realised that the above has been given only by way of illustrative example of the invention and that all such modifications and variations thereto as would be apparent to persons skilled in the art are deemed to fall within the broad scope and ambit of the invention as defined in the following claims.

I claim:

1. A carpet stretching assembly including:

an elongate substantially two-dimensional mounting structure for positioning in a stable configuration on a carpeted surface, said mounting structure comprising a plurality of modules, each having a pair of substantially parallel side rails and a plurality of transverse cross members joining said side rails, the modules being interconnectable end-to-end whereby the side rails of interconnected modules constitute a pair of longitudinally extending elongate strut members of said mounting structure;

anchoring means at one end of said mounting structure for positioning against a wall surface for anchoring said mounting structure relative to a carpet fixed to the floor adjacent the wall surface;

releasable stretching means engageable with said mounting structure and operable to stretch carpet in a longitudinal direction of said mounting structure away from said anchoring means, said stretching means having transport means guided by said mounting structure and supporting said stretching means for movement in said longitudinal direction along said mounting structure, abutment means engageable with a transverse cross member to prevent movement of said stretching means in a rearward direction towards said anchoring means and thereby locate said stretching means relative to said mounting structure, a gripping head assembly for releasably gripping the carpet, and actuating means for moving said gripping head assembly relative to said abutment means, whereby upon actuation of said actuating means and engagement of said abutment means with a cross member, carpet gripped by said gripping head assembly is stretched in a forward direction away from its point of fixing to the floor adjacent the wall surface; and carpet holding means engageable with said mounting structure intermediate said stretching means and said anchoring means and operable to maintain carpet stretched by said stretching means in a stretched condition when carpet gripped by said gripping head assembly is released, said carpet holding means having, abutment means engageable with a transverse cross member to prevent movement of said carpet holding means in a rearward direction towards said anchoring means and thereby locate said carpet holding means relative to said mounting structure, and a gripping head assembly for releasably gripping the carpet.

2. A carpet stretching assembly as claimed in claim 1, wherein said stretching means straddles said mounting structure and said transport means supports said stretching means on said carpeted surface externally of said strut members.

3. A carpet stretching assembly as claimed in claim 2, wherein said stretching means includes a frame supporting said actuating means, said transport means comprising a plurality of wheels mounted on said frame.

4. A carpet stretching assembly as claimed in claim 3, wherein said carpet holding means includes transport means guided by said mounting structure and supporting said carpet holding means for movement in said longitudinal direction.

5. A carpet stretching assembly as claimed in claim 4, wherein said mounting structure is constructed from aluminum.

6. A carpet stretching assembly as claimed in claim 5, wherein said gripping head assembly includes at least one gripping head having an array of inclined spikes projecting downwardly therefrom.

7. A carpet stretching assembly as claimed in claim 6, wherein said gripping head assembly includes at least three said gripping heads arranged such that one said gripping head is positioned centrally of said mounting structure and the other said gripping heads are respectively positioned transversely on either side thereof.

8. A carpet stretching assembly as claimed in claim 6, wherein said actuating means includes a ratchet mechanism.

9. A carpet stretching assembly as claimed in claim 6, wherein said actuating means includes a hydraulic jacking mechanism.

10. A carpet stretching assembly as claimed in claim 9, wherein the abutment means for said stretching means is fixed to a cylinder of said hydraulic jacking mechanism.

11. A carpet stretching assembly comprising:

a mounting structure having a pair of side rails interconnected by a plurality of transverse cross members;

anchoring means disposed at one end of said mounting structure for anchoring said mounting structure against a fixed surface relative to a carpet on a floor; and releasable stretching means engageable with said mounting structure and operable to stretch carpet in a direction away from said anchoring means, said stretching means having transport means guided by said mounting structure and supporting said stretching means for movement in said longitudinal direction, abutment means engageable with a transverse cross member to prevent movement of said stretching means in a direction towards said anchoring means, a gripping head assembly for releasably gripping the carpet, and actuating means for moving said gripping head assembly relative to said abutment means.

12. A carpet stretching assembly as claimed in claim 11, further comprising carpet holding means engageable with said mounting structure intermediate said stretching means and said anchoring means, and operable to maintain carpet stretched by said stretching means in a stretched condition when carpet gripped by said gripping head assembly is released, said carpet holding means having, abutment means engageable with a transverse cross member to prevent movement of said carpet holding means in a direction towards said anchoring means, and a gripping head assembly for releasably gripping the carpet.

* * * * *